US009683333B2

(12) United States Patent
Straub et al.

(10) Patent No.: US 9,683,333 B2
(45) Date of Patent: Jun. 20, 2017

(54) RAIL TIE GRIPPING MECHANISM HAVING GRIPPER FINGERS WITH TEETH

(71) Applicant: Nordco Inc., Oak Creek, WI (US)

(72) Inventors: William D. Straub, Elm Grove, WI (US); Leary C. Peterson, Franklin, WI (US)

(73) Assignee: NORDCO INC., Oak Creek, WI (US)

( * ) Notice: Subject to any disclaimer, the term of this patent is extended or adjusted under 35 U.S.C. 154(b) by 0 days.

(21) Appl. No.: 14/789,151

(22) Filed: Jul. 1, 2015

(65) Prior Publication Data

US 2016/0017546 A1 Jan. 21, 2016

Related U.S. Application Data

(60) Provisional application No. 62/024,694, filed on Jul. 15, 2014.

(51) Int. Cl.
*B66C 1/00* (2006.01)
*E01B 29/10* (2006.01)

(52) U.S. Cl.
CPC ..... *E01B 29/10* (2013.01)

(58) Field of Classification Search
CPC ..... E01B 29/10; E01B 27/12; E01B 29/09; B25J 15/0028; B25J 15/08
USPC ..... 294/106, 16, 118, 902; 104/9, 6, 7.1, 2
See application file for complete search history.

(56) References Cited

U.S. PATENT DOCUMENTS 102,049 A * 4/1870 Scanlan ..... B66C 1/422 294/106
376,220 A * 1/1888 Wood ..... B66C 1/422 294/118
541,590 A * 6/1895 Bulmer ..... B66C 1/32 294/117
993,976 A * 5/1911 Sigmund ..... B66C 1/422 294/118
1,728,084 A * 9/1929 Shroyer ..... B66C 1/58 294/118
1,807,360 A * 5/1931 Wehr ..... B65H 19/126 294/106
1,871,713 A * 8/1932 Lowenthal ..... B26B 29/063 269/218
2,622,915 A * 12/1952 Horn ..... B66C 3/16 294/106
2,818,820 A * 1/1958 Williams ..... E01B 29/09 104/2
2,950,687 A * 8/1960 McWilliams ..... E01B 29/13 104/9
3,139,302 A * 6/1964 Orloff ..... B65G 47/90 294/106

(Continued)

FOREIGN PATENT DOCUMENTS

JP 05170398 A * 7/1993

*Primary Examiner* — Gabriela Puig
(74) *Attorney, Agent, or Firm* — Greer, Burns & Crain, Ltd.

(57) ABSTRACT

A gripping mechanism is provided for use with an apparatus for removing and inserting a rail tie that needs repair or replacement from a railroad track, and includes at least one gripper lever constructed and arranged to be actuated between a closed position and an open position, and a plurality of gripper fingers. Each gripper finger is configured for being individually attachable to and removable from a corresponding one of the at least one gripper lever for grasping the rail tie.

20 Claims, 12 Drawing Sheets

(56) References Cited

U.S. PATENT DOCUMENTS 3,952,880 A * 4/1976 Hill ..... B25J 19/021 294/106
4,281,868 A * 8/1981 Lovitt ..... E01B 29/16 104/307
4,312,275 A * 1/1982 Theurer ..... E01B 27/16 104/12
4,418,625 A 12/1983 Allmer
4,538,722 A * 9/1985 Sumner ..... B65G 21/14 104/7.1
4,579,060 A * 4/1986 Nameny ..... E01B 29/10 104/9
4,770,103 A 9/1988 Allmer
4,872,646 A 10/1989 Siano
4,951,573 A 8/1990 Madison
5,025,733 A 6/1991 Pierobon
5,048,424 A 9/1991 Madison et al.
5,119,723 A 6/1992 Lovitt, Jr.
5,197,389 A 3/1993 Glomski et al.
5,305,692 A 4/1994 Madison et al.
5,617,795 A 4/1997 Glomski et al.
5,651,317 A 7/1997 Kim
5,655,455 A 8/1997 Smith
5,666,758 A * 9/1997 Vaillier ..... A01K 97/24 294/110.1
5,722,325 A 3/1998 Glomski et al.
5,813,103 A 9/1998 Girouard et al.
6,158,353 A 12/2000 Theurer
6,463,858 B2 10/2002 Weber et al.
6,543,118 B1 4/2003 Girouard, Sr. et al.
6,863,717 B2 3/2005 Johnsen et al.
7,574,961 B2 8/2009 Barezzani et al.
D612,295 S 3/2010 Noll
7,887,108 B1 * 2/2011 Cawley ..... B25J 15/022 294/106
D754,030 S * 4/2016 Straub ..... D12/51
2006/0202497 A1 * 9/2006 Cveykus ..... B66C 1/422 294/118

* cited by examiner

RAIL TIE GRIPPING MECHANISM HAVING GRIPPER FINGERS WITH TEETH

CROSS-REFERENCE

This application claims priority of U.S. Provisional Application Ser. No. 62/024,694, filed Jul. 15, 2014 under 35 U.S.C. §119(e), which is incorporated herein by reference.

BACKGROUND

The present disclosure generally relates to railroad maintenance machinery, and more particularly relates to machinery used for removing and inserting railroad ties.

Tie replacing machines are typically built to roll on a railroad track and stop at a rail tie that needs repair or replacement. Most machines have a telescoping boom member that positions a gripping mechanism normally relative to the track and adjacent to an end of the rail tie to remove it. The gripping mechanism typically has vice-like jaws that clamp onto the end of the rail tie. As the telescoping boom member extends normally away from the track, and the jaws pull the tie from under the railroad track. A reverse operation is used to insert a new tie under the track. An exemplary tie replacing machine is described in commonly assigned U.S. Pat. No. 6,463,858, which is incorporated by reference.

While these conventional machines are able to remove and replace the railroad ties, the machines are subject to disadvantages. One disadvantage is that each gripping mechanism includes a housing having a pair of jaws, each attached as a unit to a corresponding side of the housing such that the jaws grasp the rail tie for its removal or insertion. In use, the jaws wear unevenly. Because they are unitary, when only one end of the jaw is worn, the entire unit must be replaced. Also, the conventional nuts and bolts retaining the jaws to the corresponding arm become severely worn during use. As a result, replacement of the jaws often requires significant efforts by maintenance personnel.

Accordingly, there is a need for developing an improved tie gripping mechanism.

SUMMARY

The present disclosure is directed to a rail tie gripping mechanism or assembly having a pair of gripper levers and a plurality of individual gripper fingers. Specifically, the present gripping mechanism features enhanced gripping, and reduces maintenance time and costs. As a result, an improved rail tie replacement operation is achieved without compromising the operational sequence of the gripping mechanism.

Each gripper finger is separately replaceable with a new one or interchangeable with another finger because each finger has an identical configuration. As a result, costs and time needed for maintenance are reduced. The fingers weigh less than the whole gripping assembly, and thus stocking the fingers becomes easier and more convenient. Further, since only the fingers that need maintenance are removed, the installation is faster, easier, and less burdensome for the operator. Also included in each finger is a plurality of teeth for grasping the rail tie and reducing the chances of slippage or rotation of the tie during replacement.

Another important aspect is that each gripper finger is removably attached to a corresponding gripper lever using a fastener. When one or more gripper fingers are worn-out or impaired, only the fingers that need maintenance are conveniently and quickly detached from the gripper lever for replacement by unfastening the fasteners.

Each gripper lever provides a plurality of slots configured for matingly receiving corresponding gripper fingers for secure attachment. As described in further detail below, a number of support plates are provided in each gripper lever for enhancing stability of the attached gripper fingers. The gripper fingers are laterally spaced with respect to each other at a predetermined distance for distributing a load in a large area on opposite sides of the rail tie being grasped by the gripper fingers. As a result, the present gripping mechanism handles the rail ties without causing damage during operation.

In one embodiment, a gripping mechanism is provided for use with an apparatus for removing and inserting a rail tie that needs repair or replacement from a railroad track, and includes at least one gripper lever constructed and arranged to be actuated between a closed position and an open position, and a plurality of gripper fingers. Each gripper finger is configured for being individually attachable to and removable from a corresponding one of the at least one gripper lever for grasping the rail tie.

In another embodiment, a gripper finger is provided for use with an apparatus for removing and inserting a rail tie that needs repair or replacement from a railroad track. The gripper finger is configured for removably being attached to a pair of gripper levers for grasping the rail tie. Each gripper lever is actuated between a closed position and an open position. Included in the apparatus is a finger supporting member being attached to each corresponding gripper lever and configured for accommodating the plurality of gripper fingers. A plurality of teeth is disposed on a front surface of the gripper finger for securely grasping the rail tie. Each tooth protrudes from the front surface and the plurality of teeth is vertically arranged and spaced on the front surface at a predetermined distance. The gripper finger is configured for being individually replaceable from the corresponding gripper.

DETAILED DESCRIPTION

Figure 1:
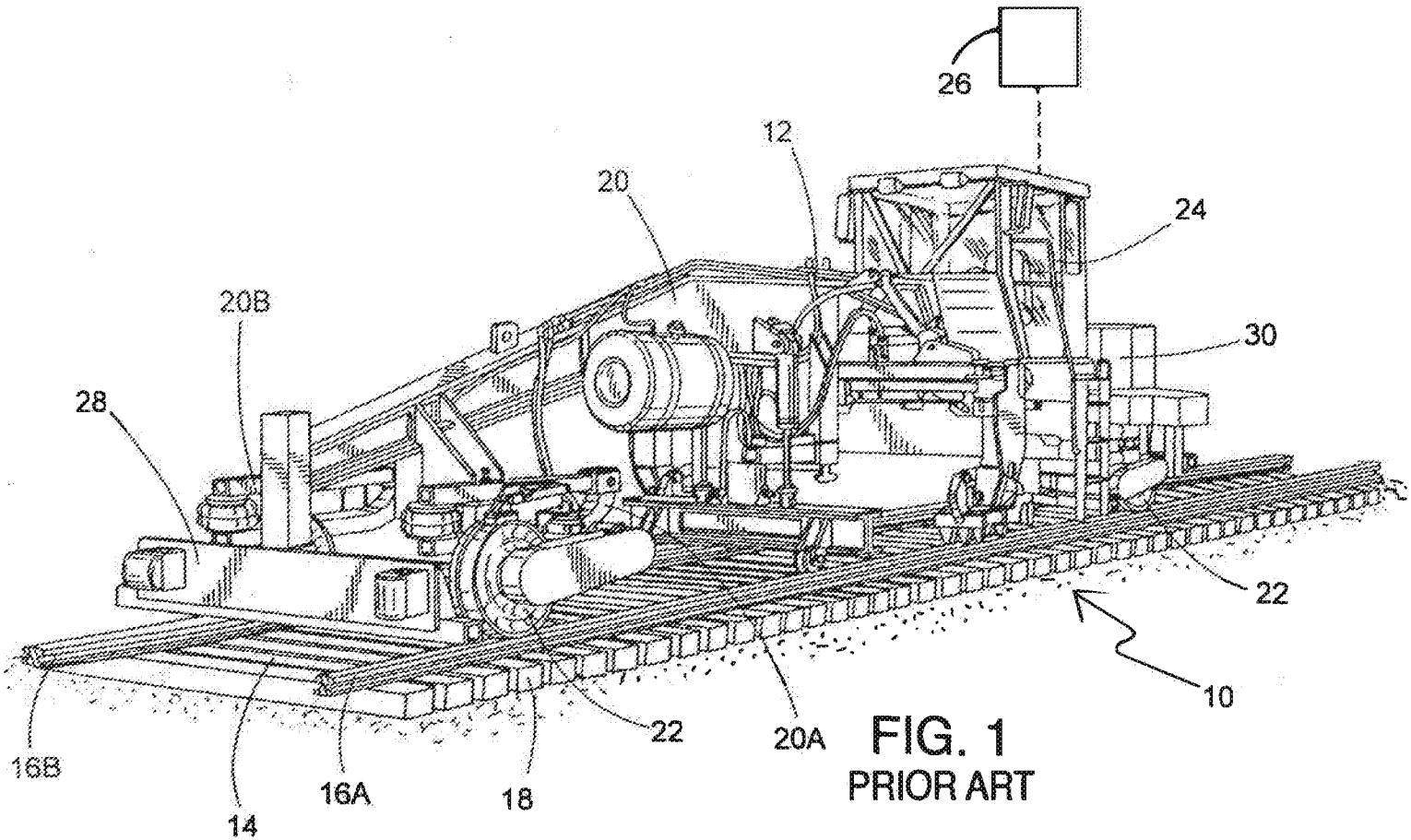
FIG. 1 PRIOR ART
FIG. 1 is a front perspective view of a prior art railroad maintenance machine including an exemplary rail tie replacement apparatus.
Figure 2:
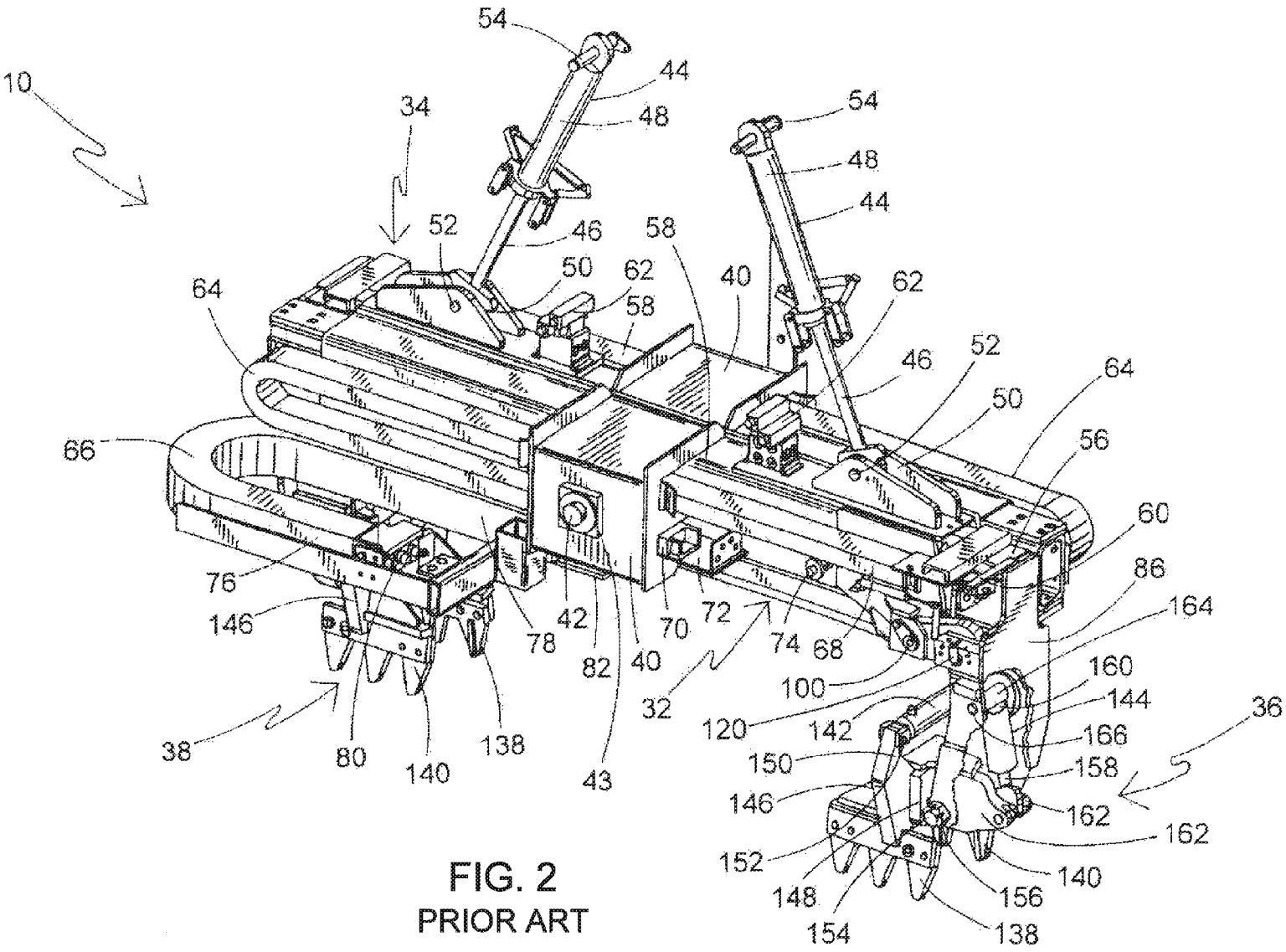
FIG. 2 PRIOR ART
FIG. 2 is a top perspective view of the prior art rail tie replacement apparatus portion of the machine of FIG. 1.

Referring now to FIGS. 1 and 2, an exemplary rail tie replacement apparatus is generally indicated at 10 and is attached to a railway repair machine 12. The railway repair machine 12 is preferably designed to be self-propelled on a railroad track 14. It is also contemplated, however, that the machine 12 is configured to be propelled along the track 14 by another vehicle. Several types of rail tie replacement apparatus are known, and exemplary models are described in commonly assigned U.S. Pat. No. 6,463,858.

The track 14 includes first and second rails 16*a*, and 16*b*, respectively, and a plurality of rail ties 18, typically made of wood. Furthermore, the machine 12 includes a frame 20 supported on a plurality of wheels 22 such that the frame is driven along the rails 16*a*, 16*b*. The frame 20 supports a source of motive power such as an internal combustion engine (not shown), which propels the machine 12 and also powers a fluid power system (not shown), which in the preferred embodiment is hydraulic, and an operator's cab 24 housing a control system, schematically shown at 26.

It will be evident that the frame 20 has a first side 20*a* and a second side 20*b*, each side corresponding to one of the rails 16*a*, 16*b*. In addition, the frame 20 has a first or front end 28 and a second or rear end 30. The operator's cab 24 is situated nearer to the rear end 30 of the machine 12 and enables the operator to observe and control repair operations on either rail 16*a* or 16*b*. A first extending member 32 and a second extending member 34 are attached to the frame 20 in a non-axial relationship to each other, and control the positioning of a first gripping mechanism 36 and a second gripping mechanism 38 relative to the plurality of rail ties 18. In the preferred embodiment, the first and second extending members, 32 and 34 respectively, are positioned directly adjacent to each other, but it is also contemplated that first and second extending members may be positioned in spaced apart orientation at other locations along the frame 20.

In existing railroad repair machines, the reciprocal movement of the extending members 32, 34 causes increased stress at an attachment point where the frame and the extending member are connected. Furthermore, when the extending members are fully extended, the weight of each member adds additional stress to the attachment point and the extending member itself. A non-axial relationship of the members 32 and 34 provides increased stability and strength, and eliminates the conventional attachment point. Thus, the stress caused by the reciprocal movement of the extending members 32 and 34 is reduced because of the non-axial or side-by-side positioning of the members 32 and 34. As a result, the operational failure and replacement cost associated with existing machines is decreased substantially with the apparatus 10.

Referring now to FIG. 2, each extending member 32, 34 operates in the same manner, therefore the operation of only one of the extending members will be described. Each extending member 32, 34 is slidingly engaged and supported by a frame support 40. The frame supports 40 are preferably attached to each other, as by welding, and are attached to the main frame 20 by slider rods 42. The position of the rail tie replacement apparatus 10 may be vertically adjusted relative to the frame 20 depending on the task to be performed. The slider rods 42 are welded to a side surface of each frame support 40 and fit within corresponding grooves (not shown) formed on the frame 20. A wear plate or roller 43 is also engaged with the frame grooves. The slider rods 42 then matingly engage the corresponding grooves on the frame 20 and vertically slide up or down within the grooves depending on the operation of a pair of hydraulic cylinders 44 that are controlled by the operator.

The hydraulic cylinders 44 control the vertical positioning of the rail tie replacement apparatus 10 within the channels. Each hydraulic cylinder 44 includes a rod end 46 and a blind end 48. While other orientations are contemplated, the rod end 46 is secured to a bracket 50 with a pin 52. On the opposite end, the blind end 48 is secured to the frame 20 by inserting the blind end into a bracket (not shown) on the frame and securing the attachment with a flanged pin 54, which is attached to the bracket by a threaded fastener or other fastening devices known in the art. In operation, the hydraulic cylinders 44, raise and lower the rail tie replacement apparatus 10 relative to the frame 20, according to an operator's instructions which are transmitted into the control system 26. If an operator wishes to raise the apparatus 10, an instruction is sent via the control system 26 to retract the hydraulic cylinders 44.

In situations where the ground is uneven or a different gripping angle is needed, the operator adjusts the apparatus 10 such that one side of the apparatus 10 is lower than the other side. This tilting process is achieved by extending or retracting only one or both of the hydraulic cylinders 44. Once the rail tie replacement apparatus 10 is vertically positioned relative to the track 14, the gripping mechanism, either 36 or 38, is positioned relative to the rail tie 18 that needs repair or replacement.

The gripping mechanisms 36 and 38 are formed horizontally on the same weldment as extending members 32 and 34 respectively. An inner element 56 of each extending member 32 and 34 slides generally horizontally in and out of the corresponding frame support 40. The first extending member 32 includes the inner element 56 and an outer element 58. The inner element 56 is attached to the first gripping mechanism 36 on a first end 60, and is slidingly engaged within the outer element 58. To provide structural stability, the outer element 58 is secured at an inner end to the frame support 40.

In addition, a manifold 62 is positioned on top of the outer elements 58 of the extending members 32, 34 and is provided with a valve (not shown) as is known in the art, controlling the hydraulic pressures supplied to the various hydraulic components of the gripping mechanisms 36 and 38. The manifolds 62 are secured to the tops of the outer elements 58 by threaded fasteners or other similar fastening device as known in the art.

Furthermore, a first guide hose 64 and a second guide hose 66 are positioned on its side in two different locations along the extending members 32 and 34 to protect hydraulic tubing attached to various components within the rail tie replacement apparatus 10. One end 68 of the first guide hose 64 is fastened to the top of the gripping mechanism 36. An opposite end 70 of the first guide hose 64 is secured to a support plate 72 which is secured to the outer element 58 of the extending member 32. Also, a hose guide roller 74 is situated on the outside surface of the outer element 58 to provide additional support to and facilitate movement of the guide hose 64.

Similarly, the second guide hose 66 has an end 76 and an opposite end 78. The end 76 is secured to a bracket mount 80. An opposite end 78 of the guide hose 66 is attached to a mounted support channel 82. The mounted support channel 82 is welded or fastened to the bottom portion of the frame support 40. As attached, the support channel 82 extends outward and below the frame support 40, thereby maintaining a planar relationship between the end 76 and the opposite end 78.

Referring now to FIG. 2, movement of the first and second extending members 32 and 34 respectively is controlled by the double-acting fluid power of hydraulic cylinders (not shown). Each hydraulic cylinder is attached to housings 86 of the gripping mechanisms 36 and 38, and other conventional attachment devices may be used to fasten the hydraulic cylinders to the housings 86. Once the first extending member 32 extends over the first rail 16*a*, the gripping mechanism 36 is maneuvered into place to grab the rail tie 18. Each gripping mechanism 36, 38 includes the housing 86, a first jaw 88, a second jaw 90, a first hydraulic cylinder 92 and a second hydraulic cylinder 94. The housing 86 is attached to the inner element 56 by threaded fasteners, welding or other fastening technology as is known in the art. Also, the housing 86 projects downward from the inner element 56 and provides the main support for the first gripping mechanism 36.

The first jaw 88 and second jaw 90 are disposed on either side of the housing 86. Each jaw 88, 90, attaches to a gripper assembly 96. The gripper assembly 96 is pivotally attached to a pivot bracket 98. In addition, to facilitate the opening and closing of the jaws 88, 90, the first hydraulic cylinder 92 attaches to an upper end 100 of the gripper assemblies 96. The ends of the first hydraulic cylinder 92 are configured as clevis brackets, which are secured to the upper ends 100 of the gripper assemblies 96 by pins 102 and cotter fasteners (not shown) or other fastening devices known in the art.

Each pivot bracket 98 is pivotally attached to the housing 86 by gripper pins 104, where the gripper pins slide into an opening in the housing 86 and through a corresponding opening in the bracket 98. Once the gripper pin 104 has pivotally attached the bracket 98 to the housing 86, it is fastened into place by a nut 106. As attached, the brackets 98 may pivot about the gripper pins 104 so that the gripper assemblies 96 and corresponding jaws 88, 90 may be pivoted or tilted as needed to grasp the rail tie 18.

The second hydraulic cylinder 94 is utilized to promote the pivoting movement of the pivoting brackets 98. A first end 108 of the second hydraulic cylinder 94 is pivotally secured to ears 110 located on the pivot bracket 98. A second end 112 of the second hydraulic cylinder 94 is pivotally attached to the housing 86. A hollow tube 114 is welded or formed on the second end 112, such that a pin or other fastening rod may be inserted through the tube 114. The tube 114 is aligned with corresponding holes located on each side of the housing 86. Once the holes are aligned with the hollow tube 114, a pin 116 is inserted through the holes and is secured to the housing 86 by a threaded fastener or similar device known in the art.

Figure 3:
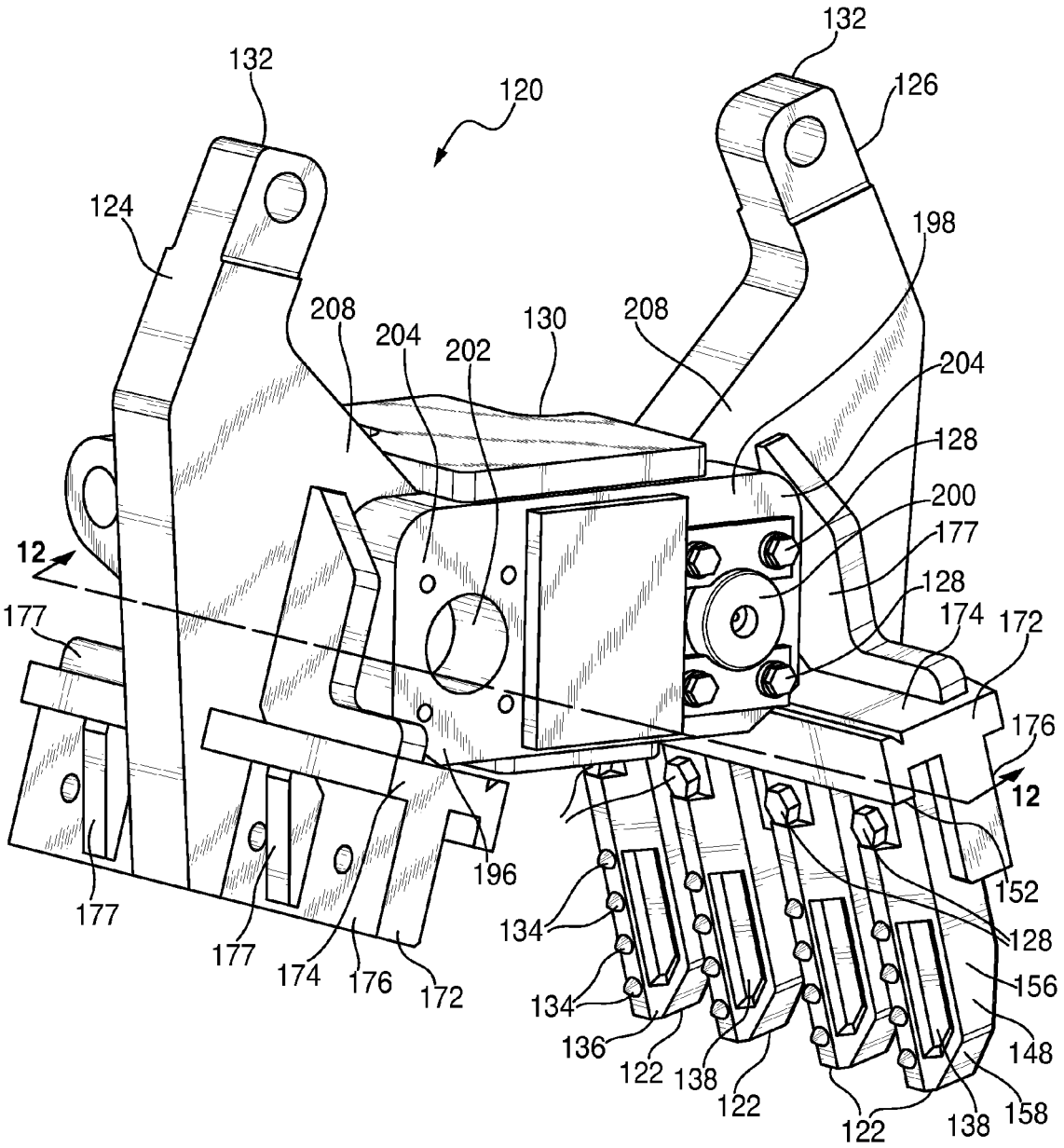
FIG. 3 is a fragmentary side perspective view of the present gripping mechanism, featuring a pair of gripper levers having a plurality of gripper fingers, and a gripper pivot bracket.

Referring now to FIGS. 1-3, in the preferred embodiment, it is contemplated that the first and second gripping mechanisms 36, 38 are replaced with the present gripping mechanisms, generally designated 120 (FIG. 3), which are newly designed for providing an improved rail tie replacement operation. Since each present gripping mechanism 120 operates in the same manner, the operation of only one of the present gripping mechanisms will be described. Included in the present gripping mechanism 120 is a plurality of gripper fingers 122, which are removably or releasably attached to a pair of gripper levers, namely a first gripper lever 124 and a second gripper lever 126, using fasteners 128.

An important feature of the present mechanism 120 is that the present gripper fingers 122 are individually replaceable from the corresponding lever 124, 126. In operation, the first and second gripper levers 124, 126 are constructed and arranged to be actuated between a closed (or gripping) position and an open (or releasing) position under the action of the first hydraulic cylinder 92, but other types of devices, such as pneumatically or mechanically biased, e.g., spring biased, mechanisms are also contemplated as known in the art.

As is the case with the jaws 88, 90, each gripper lever 124, 126 is attached to a gripper pivot bracket 130, which replaces the pivot bracket 98, and is newly designed for accommodating attachment of the gripper levers. To facilitate the opening and closing of the gripper levers 124, 126, the first hydraulic cylinder 92 attaches to an upper end 132 of the corresponding gripper lever. As described above, in the preferred embodiment, the ends of the first hydraulic cylinder 92 are configured as clevis brackets, which are secured to the upper ends 132 of the gripper levers 124, 126 by suitable fastening devices known in the art. As is the case with all of the hydraulic cylinder connections described in the apparatus 10 and the mechanism 120, other known pivotable cylinder connections are contemplated.

Referring now to FIGS. 3-9, the gripper finger 122 is illustrated in greater detail. An aspect of the present gripping mechanism 120 is that each gripper finger 122 has a plurality of generally axially spaced teeth 134 disposed on a front surface 136 of the finger for securely grasping the rail tie 18 without causing slippage or rotation of the tie during operation. Each tooth 134 protrudes or extends from the front surface 136, and is preferably made of tungsten carbide, but other suitable types of materials are also contemplated.

Another feature of the gripper finger 122 is that at least one pocket or recess 138 is provided on at least one of a bottom surface 140 and selected regions of the front surface 136 of the finger for receiving wear resistant hard-facing materials to protect the outer surfaces of the finger. It is contemplated that the hard-facing materials include tungsten carbide or cobalt bonded carbide, and are deposited into the pockets 138 such that the gripper finger 122 is protected from wear, stress, or abrasion during use. Other types of hard-facing methods are also contemplated to suit the application.

In the preferred embodiment, the front surface 136 has a vertical planar face 142 positioned between a pair of inclined faces 144, where each inclined face is horizontally or laterally angled from the front planar face toward a corresponding side surface 146, 148 of the finger 122. Preferably, the teeth 134 are arranged on the front planar face 142, and at least one pocket 138 is arranged on the inclined faces 144. As described in greater detail below, the front surface 136 has a front planar region 150 configured for matingly engaging a horizontal, rectangular-shaped overhang portion 152 of each gripper lever 124, 126 for securely holding the gripper fingers 122. A bore 154 is provided on the front planar region 150 for receiving the fastener 128 so that each finger 122 is secured to the corresponding gripper lever 124, 126 by fastening the fastener. Through the mutual engagement of the finger 122 in the lever 124, 126, only a single fastener 128 is needed to secure each finger in place. Once secured, the finger 122 is supported against misalignment caused by operationally-induced forces.

Figure 4:
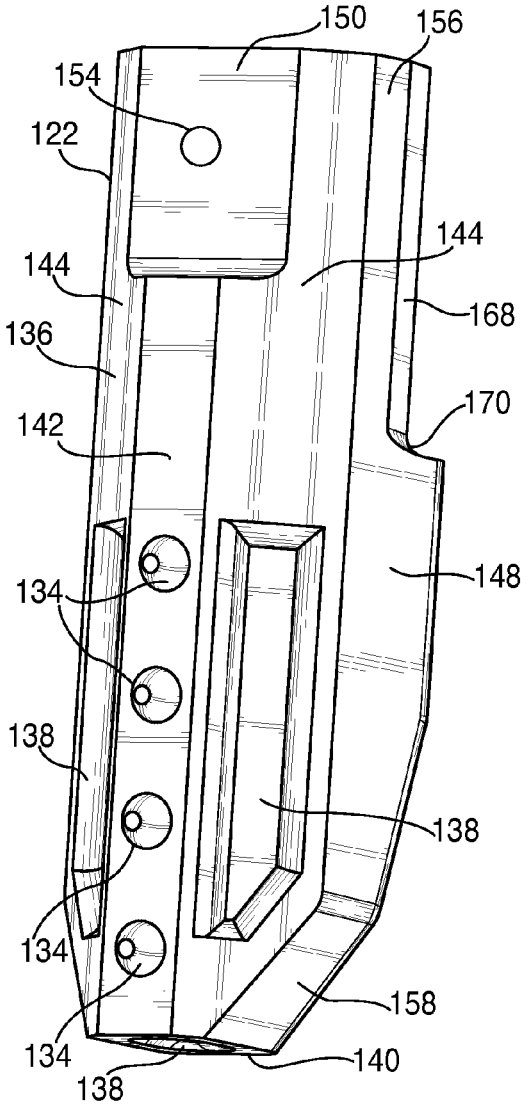
FIG. 4 is a front perspective view of the present gripper finger of FIG. 3.
Figure 5:
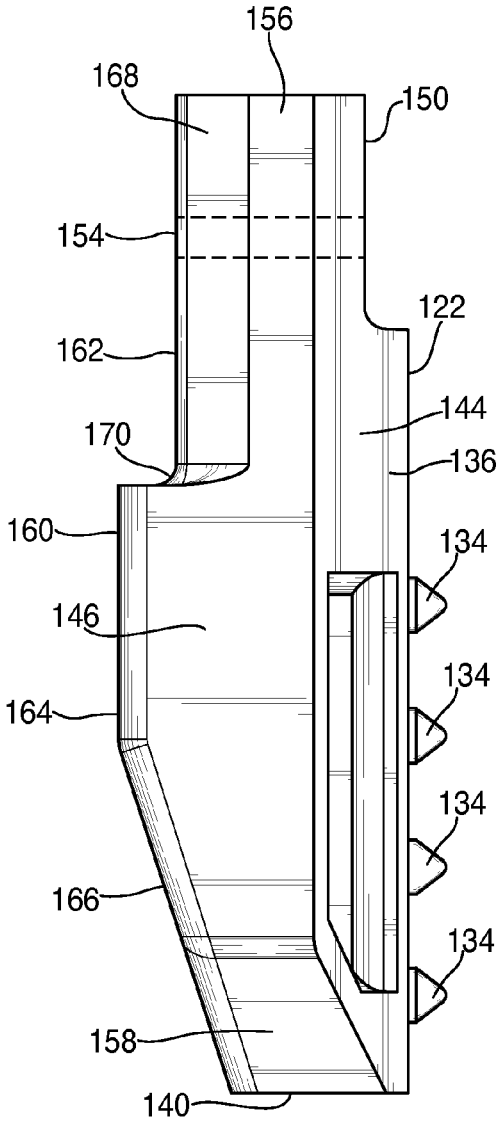
FIG. 5 is a side view of the present gripper finger of FIG. 3.
Figure 6:
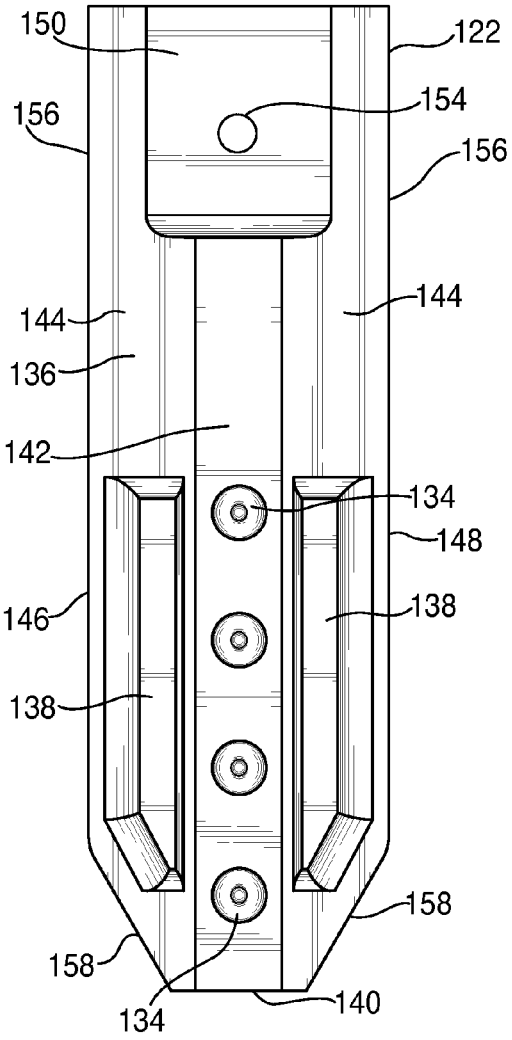
FIG. 6 is a front view of the present gripper finger of FIG. 3.
Figure 7:
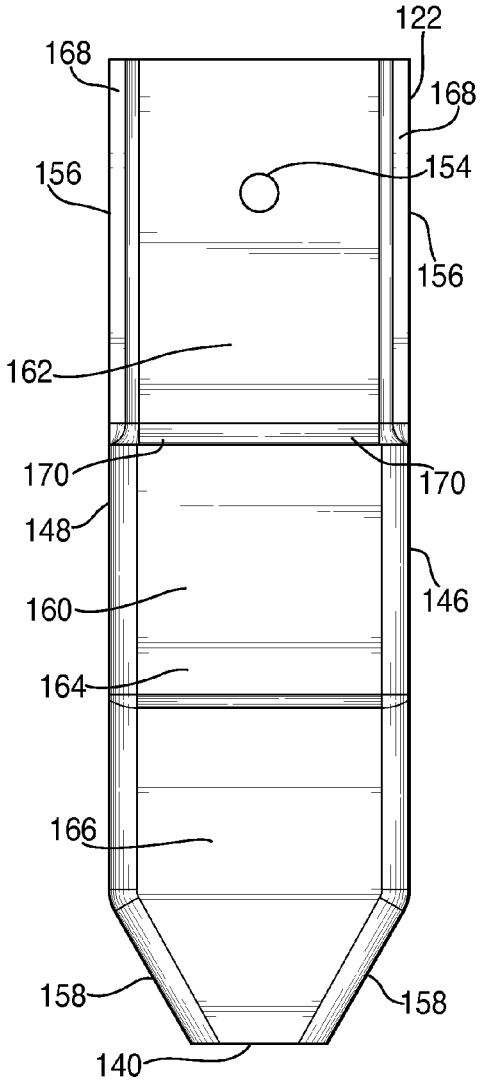
FIG. 7 is a rear view of the present gripper finger of FIG. 3.
Figure 8:
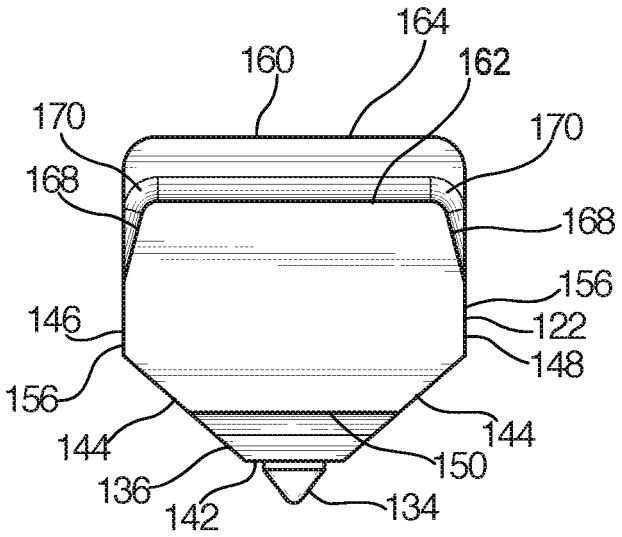
FIG. 8 is a plan view of the present gripper finger of FIG. 3.
Figure 9:
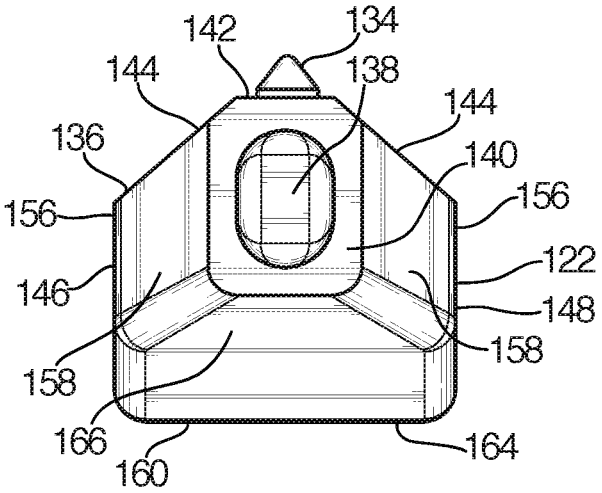
FIG. 9 is a bottom view of the present gripper finger of FIG. 3.

As shown in FIGS. 4 and 5, each gripper finger 122 has the first or left side surface 146, and the second or right side surface 148. Each side surface 146, 148 has an elongated planar side 156 having variable widths, preferably narrower in an upper region of the elongated planar side, and wider in a lower region of the elongated planar side, and has an inclined or tapered side 158 that is downwardly angled from the planar side toward the bottom surface 140. This configuration facilitates insertion of the finger 122 into the rail ballast. A rear surface 160 of each gripper finger 122 has a first rear planar region 162 having the bore 154, a separate second rear planar region 164, and a rear inclined or tapered region 166 that is downwardly angled toward the bottom surface 140. This configuration of the tapered sides 158 of the side surfaces 146, 148 and the tapered region 166 of the rear surface 160 provides an enhanced ballast digging configuration for the present gripping mechanism 120.

In the preferred embodiment, the first rear planar region 162 is positioned between a pair of inclined sides 168, where each inclined side is horizontally or laterally angled from the first rear planar region toward the elongated planar side 156 of the corresponding side surface 146, 148 of the finger 122. A radiused or curved corner 170 is provided between the first and second rear planar regions 162, 164 for separating the first and second rear planar regions such that the second rear planar region 164 is positioned higher than the first rear planar region 162 relative to the vertical planar surface 142.

Figure 10:
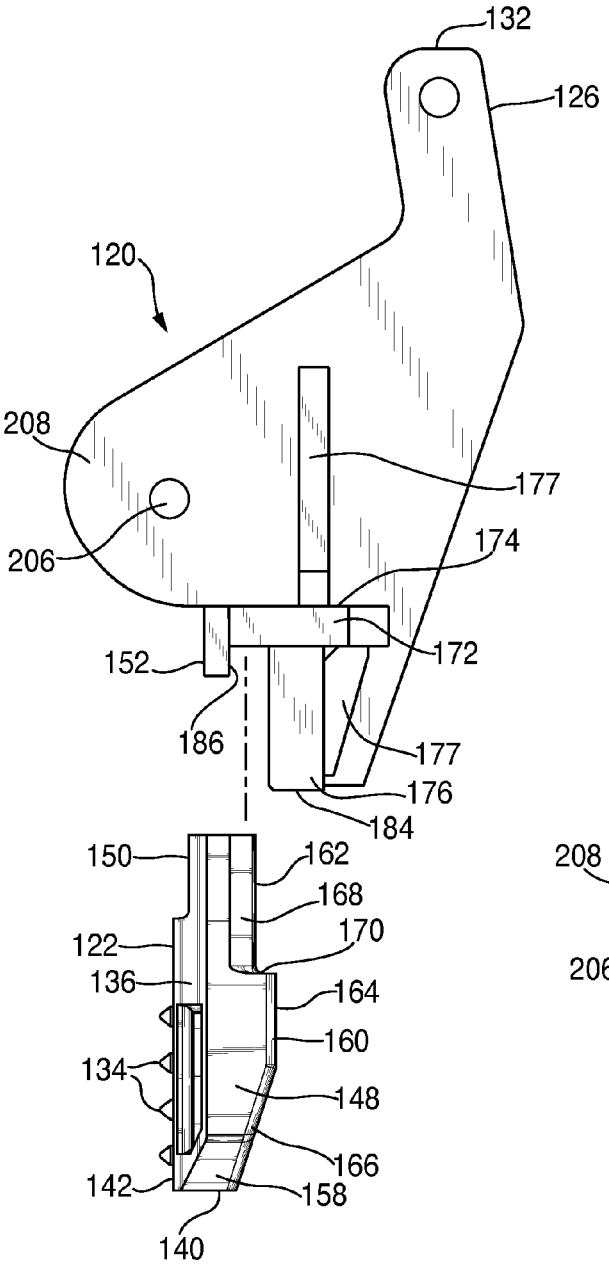
FIG. 10 is a partially exploded side view of the present gripper finger and lever of FIG. 3 before assembly.
Figure 11:
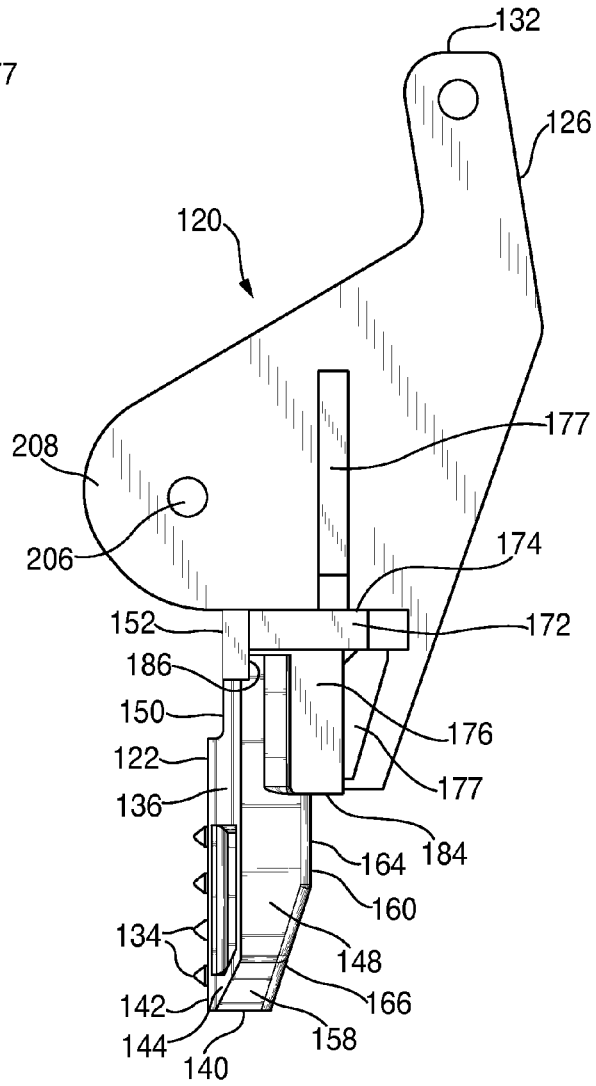
FIG. 11 is an assembled side view of the present gripper finger and lever of FIG. 3.

Referring now to FIGS. 3 and 10-12, each gripper lever 124, 126 has the overhang portion 152 integrally formed with a finger supporting member 172 having a generally "T"-shaped configuration when viewed from the side of the gripper lever (FIGS. 10 and 11). It is contemplated that the finger supporting member 172 is a region or portion of the corresponding gripper lever 124, 126, configured for supporting the gripper fingers 122. In the preferred embodiment, the overhang portion 152, a top portion 174, and a back portion 176 of the finger supporting member 172 each have a generally rectangular shape, but other suitable geometric shapes are also contemplated. It is contemplated that the finger supporting member 172 is attached to or integrally formed with the portion of the corresponding gripper lever 124, 126 transverse to a plane defined by the gripper lever by welding or other fastening technology known in the art.

Further, at least one gusset 177 is attached to the finger supporting member 172 for supporting the connection between the finger supporting member and the corresponding gripper lever 124, 126. In the preferred embodiment, the at least one gusset 177 is provided on at least one of an upper surface of the top portion 174 and a rear surface of the back portion 176. While triangular-shaped and "L"-shaped gussets 177 are shown for illustration purposes, other types of gussets are contemplated to suit the application. The gussets 177 are added not only for enhanced strength, but also for reducing drag when plunged into railroad ballast.

Figure 12:
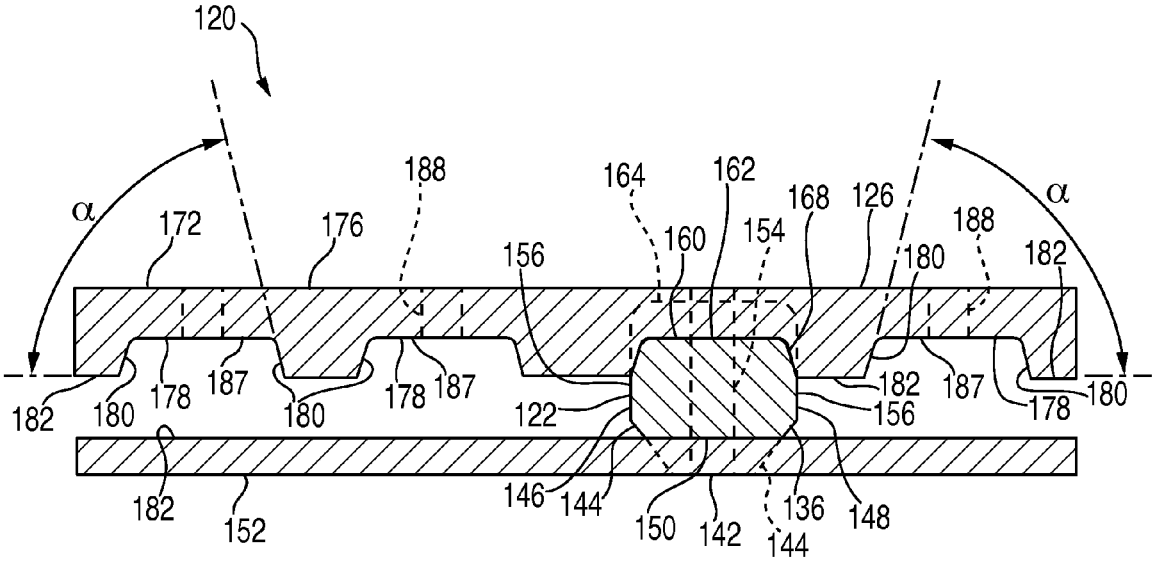
FIG. 12 is a horizontal cross-section taken along the line 12-12 of FIG. 3 and in the direction generally indicated.
Figure 13:
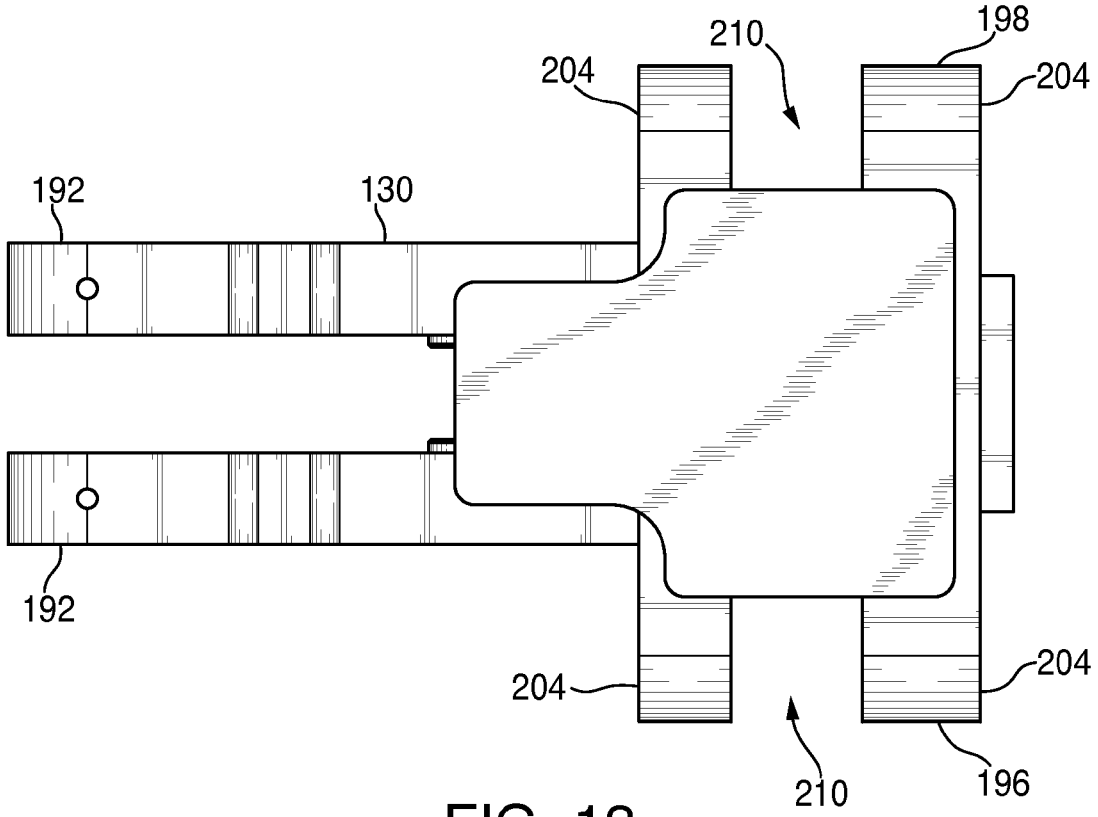
FIG. 13 is a plan view of the present gripper pivot block of FIG. 3.
Figure 14:
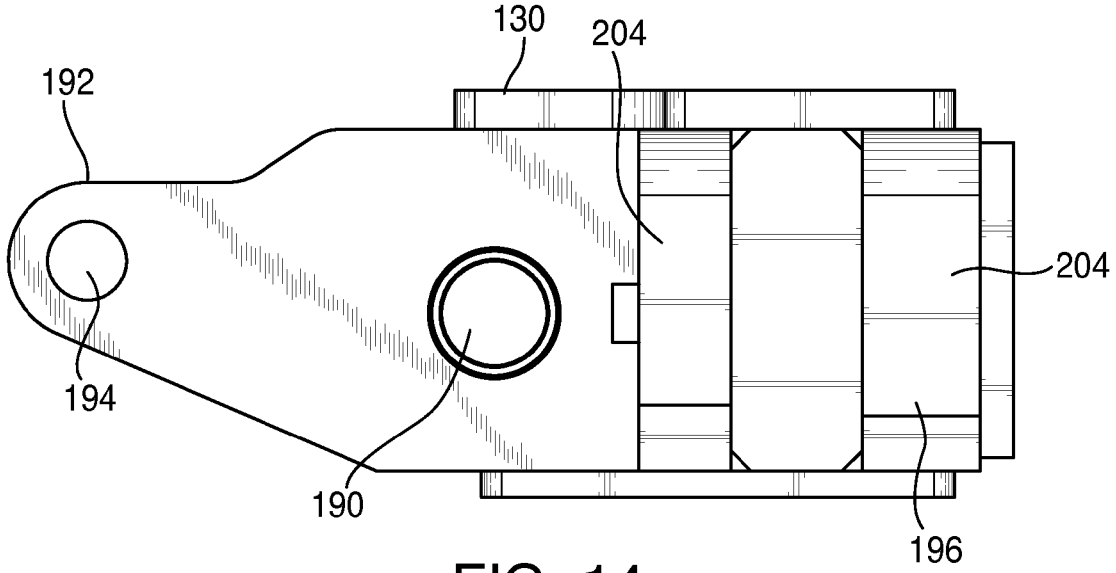
FIG. 14 is a side view of the present gripper pivot block of FIG. 3.
Figure 15:
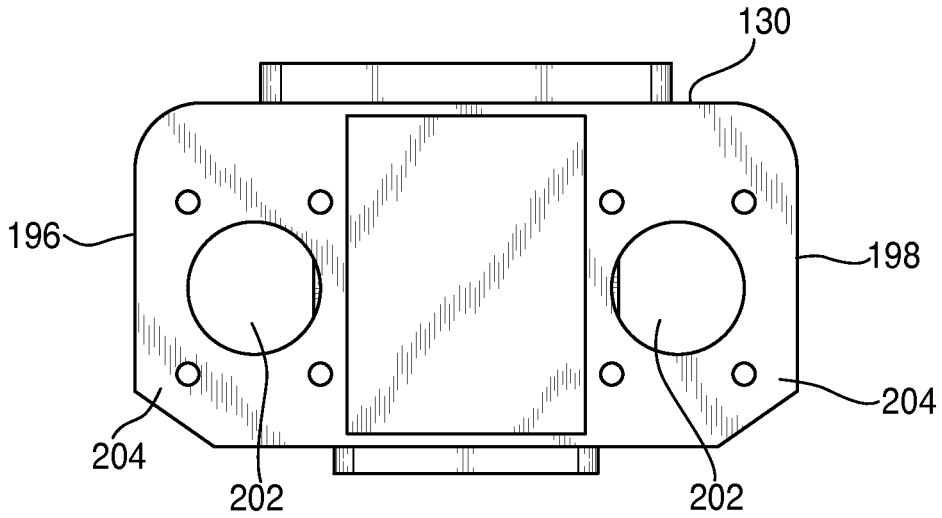
FIG. 15 is a rear view of the present gripper pivot block of FIG. 3.

As illustrated in FIG. 12, the back portion 176 of the finger supporting member 172 has a plurality of slots 178 configured for accommodating insertion of the gripper fingers 122 for enhancing stability of the gripper fingers in the direction transverse to the rails 16A, 16B. In the preferred embodiment, the gripper fingers 122 are laterally spaced with respect to each other at a predetermined distance for distributing a load in a large area on opposite sides of the rail tie 18. Each slot 178 has a generally "C"-shaped configuration in cross-section when viewed from above, following a profile or contour of the rear surface 160 having the first rear planar region 162 and the pair of inclined sides 168. While the "C"-shaped configuration is shown for illustration purposes, other suitable geometric shapes are contemplated to suit the application.

As described above, each inclined side 168 of the side surfaces 146, 148 is angled from the first rear planar region 162 toward the elongated planar side 156 of the corresponding side surface 146, 148. Similarly, each slot 178 has two inner side walls 180 that are inclined at a predetermined angle $\alpha$ relative to an outer front wall 182 of the back portion 176 of the finger supporting member 172 (FIG. 12). An exemplary angle $\alpha$ is approximately 75 degrees, but other suitable angles are contemplated depending on the application. This configuration of the slots 178 prevents side-to-side rotations during the gripping operation, and distributes the load in multiple directions.

As illustrated in FIGS. 10-12, each gripper finger 122 is slidingly inserted into the corresponding slot 178 from a lower end 184 of the finger supporting member 172, such that the front planar region 150 of the gripper finger matingly engages an inner surface 186 of the overhang portion 152 of the finger supporting member. This interface between the overhang portion 152 and the gripper fingers 122 counteracts the load in the direction of the rails 16A, 16B during operation, and prevents forward and rearward rotations in the slots 178. Simultaneously, the inclined sides 168 of the side surfaces 146 and the first rear planar region 162 matingly engage the inner side walls 180 and an inner back wall 187 of the slot 178 for securing the inserted finger 122. Similarly with the gripper finger 122, a bore 188 is provided on the back wall 187 of each slot 178 for receiving the fastener 128 so that the fingers are secured to the finger supporting member 172 by fastening the fasteners through the bores 154 and 188. Other fingers 122 are attached to the corresponding gripper lever 124, 126 in the same manner.

Referring now to FIGS. 2, 3, and 13-15, similarly with the pivot bracket 98, the gripper pivot bracket 130 is pivotally attached to the housing 86 by the gripper pins 104, where the gripper pins slide into an opening in the housing 86 and through a corresponding opening 190 in the gripper pivot bracket 130. Once the gripper pin 104 has pivotally attached the gripper pivot bracket 130 to the housing 86, it is fastened into place by the nut 106. As attached, the gripper pivot brackets 130 are pivotable about the gripper pins 104 so that the gripper levers 124, 126 may be pivoted or tilted as needed to grasp the rail tie 18. The second hydraulic cylinder 94 controls the pivoting movement of the pivoting brackets 130. The first end 108 of the second hydraulic cylinder 94 is pivotally secured to ears 192, each having a bore 194, of the gripper pivot bracket 130.

It is preferred that a first clevis bracket 196 and an opposite second clevis bracket 198 are integrally formed with the gripper pivot bracket 130 transverse to the ears 192 for pivotally connecting the gripper levers 124, 126 to the gripper pivot bracket. For example, the second gripper lever 126 is pivotally attached to the gripper pivot bracket 130 by a bracket pin 200 (FIG. 3), such that the bracket pin slides into corresponding openings 202 (FIG. 15) disposed on opposite outer ends 204 of the first and second clevis brackets 196, 198, and a lever bore 206 (FIGS. 10-11) disposed on a protrusion portion 208 of the second gripper lever 126. The lever bore 206 and the protrusion portion 208 are provided for both the first and second gripper levers 124, 126 in a similar manner.

When the bracket pin 200 has pivotally attached the second gripper lever 126 to the second clevis bracket 198, it is secured by the fasteners 128 or other fastening devices known in the art (FIG. 3). A diameter of the bracket pin 200 in the present gripper pivot bracket 130 is larger than that of the conventional pivot bracket 98. Further, a thickness of the gripper levers 124, 126 in the present gripping mechanism 120 is greater than that of the conventional gripper assembly 96. These increases in the diameter and the thickness reduce pin wear, and enhance pin life by increasing a bearing surface area between adjacent components. Other additional support plates, such as a top plate, a bottom plate, auxiliary side plates, are also contemplated depending on different applications.

Figure 16A:
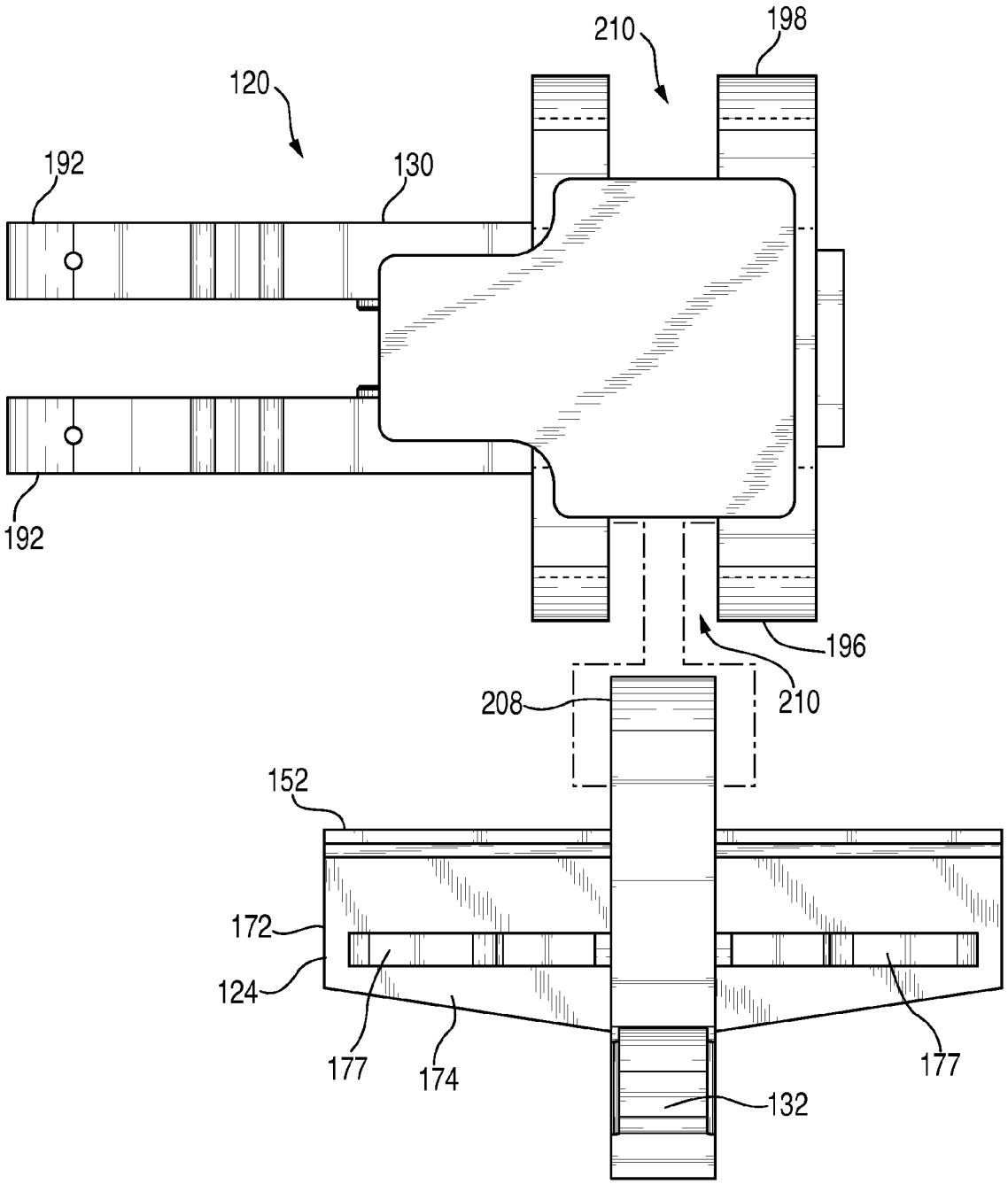
FIG. 16A is a partially exploded plan view of the present gripper pivot block and levers of FIG. 3 before assembly.
Figure 16B:
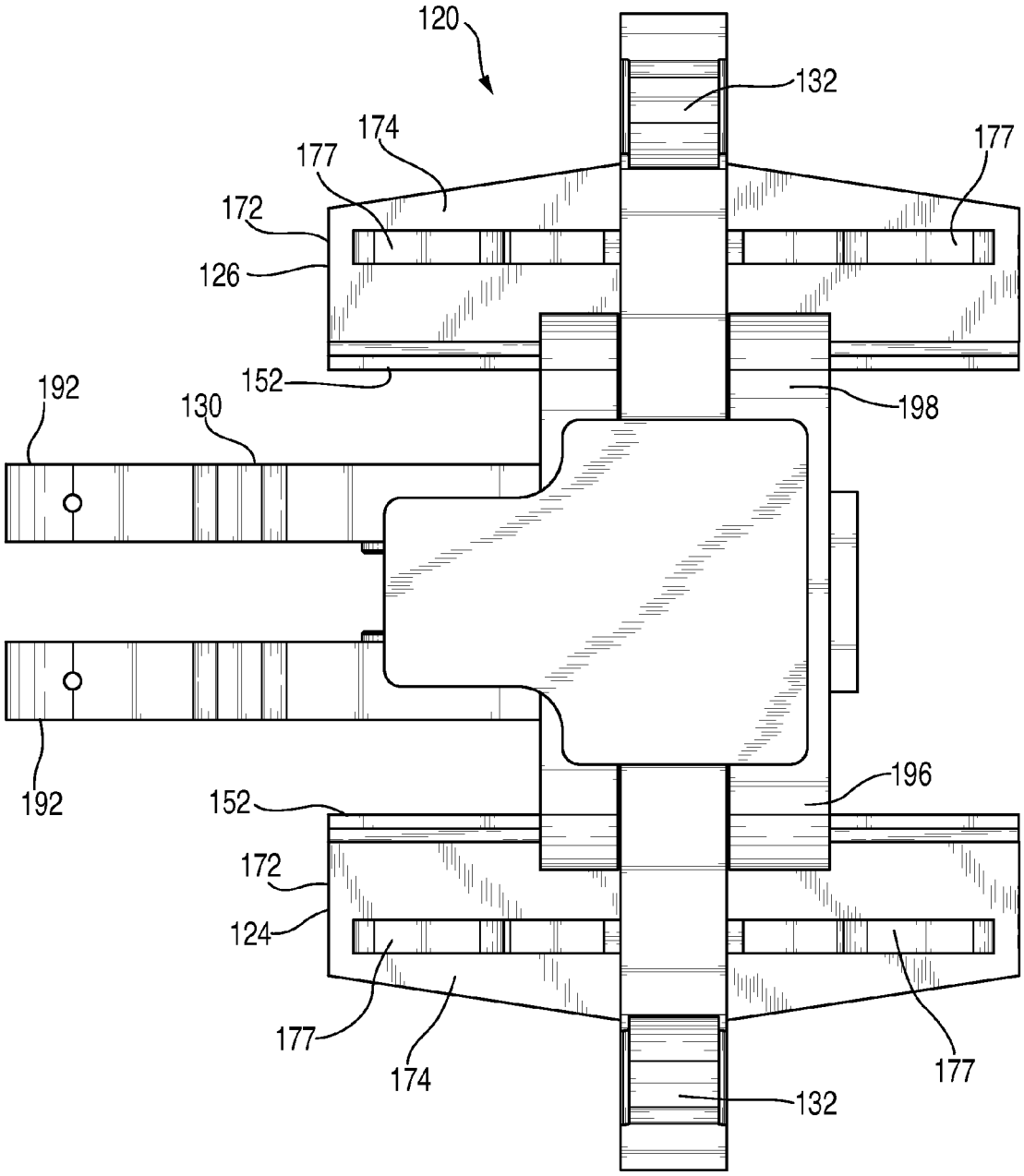
FIG. 16B is a schematic plan view of the present gripper pivot block and levers of FIG. 3 after assembly.

Referring now to FIGS. 2, 3, and 16A-16B, to facilitate the opening and closing of the gripper levers 124, 126, the first hydraulic cylinder 92 attaches to the upper end 132 of the corresponding gripper lever. As shown in FIG. 16A, the first gripper lever 124 is pivotally attached to the gripper pivot bracket 130 by inserting the protrusion portion 208 of the first gripper lever into a cavity 210 defined by the first clevis bracket 196, such that the corresponding openings 202 (FIG. 15) of the first and second clevis brackets, and the lever bore 206 (FIGS. 10-11) are aligned for receiving the bracket pin 200 (FIG. 3). As shown in FIG. 16B, after the bracket pin 200 secures the first gripper lever 124 to the gripper pivot bracket 130, the second gripper lever 126 is attached to the gripper pivot bracket in the same manner.

While a particular embodiment of the present gripping mechanism has been described herein, it will be appreciated by those skilled in the art that changes and modifications may be made thereto without departing from the present disclosure in its broader aspects and as set forth in the following claims.

What is claimed is:

1. A gripping mechanism for use with an apparatus for removing and inserting a rail tie that needs repair or replacement from a railroad track, the gripping mechanism comprising:

at least one gripper lever constructed and arranged to be actuated between a closed position and an open position; and a plurality of gripper fingers, each gripper finger configured for being attachable to and removable from a corresponding one of the at least one gripper lever for grasping the rail tie, wherein a front surface of the gripper finger has a front vertical planar face positioned between a pair of inclined faces, each inclined face being horizontally angled from the planar face toward a corresponding side surface of the finger.

2. The gripping mechanism of claim 1, wherein each gripper finger has a plurality of teeth disposed on the front surface of the finger for securely grasping the rail tie, each tooth protruding from the front surface.

3. The gripping mechanism of claim 2, wherein the teeth are vertically arranged and spaced on the front surface at a predetermined distance.

4. The gripping mechanism of claim 1, wherein at least one pocket is provided on at least one of a bottom surface and selected regions of the front surface of each gripper finger for receiving wear resistance hard-facing materials.

5. The gripping mechanism of claim 1, wherein a plurality of teeth is arranged on the planar face, and at least one pocket is arranged on the inclined faces.

6. The gripping mechanism of claim 1, wherein the front surface of each gripper finger has a front planar region configured for matingly engaging a horizontal overhang portion of each gripper lever for securely holding the gripper fingers.

7. The gripping mechanism of claim 6, wherein a bore is provided on the front planar region for receiving a fastener so that each finger is secured to the corresponding gripper lever by fastening the fastener.

8. The gripping mechanism of claim 1, wherein each gripper finger has a first side surface and a second side surface, each side surface having an elongated planar side having variable widths, and a tapered side being downwardly angled from the planar side toward a bottom surface of the finger.

9. The gripping mechanism of claim 1, wherein a rear surface of each gripper finger has a first rear planar region, a second rear planar region, and a rear tapered region that is downwardly angled from the second rear planar region toward a bottom surface of the finger.

10. The gripping mechanism of claim 9, wherein the first rear planar region is positioned between a pair of inclined sides, each inclined side being horizontally angled from the first rear planar region toward a corresponding side surface of the finger.

11. The gripping mechanism of claim 9, wherein a radiused corner is provided between the first and second rear planar regions for separating the first and second rear planar regions such that the second rear planar region is positioned higher than the first rear planar region relative to the front vertical planar surface of the finger.

12. The gripping mechanism of claim 1, wherein each gripper lever has a horizontal overhang portion integrally formed with a finger supporting member configured for accommodating the plurality of gripper fingers, thereby having a generally "T"-shaped configuration in cross-section when viewed from the side of the gripper lever.

13. The gripping mechanism of claim 12, wherein the finger supporting member is attached to the corresponding gripper lever transverse to a plane defined by the gripper lever.

14. The gripping mechanism of claim 12, wherein at least one gusset is attached to the finger supporting member for supporting and connecting the finger supporting member and the corresponding gripper lever.

15. The gripping mechanism of claim 12, wherein a back portion of the finger supporting member has a plurality of slots configured for accommodating insertion of the gripper fingers for enhancing stability of the gripper fingers.

16. The gripping mechanism of claim 15, wherein each slot has a generally "C"-shaped configuration in cross-section when viewed from above, following a contour of a rear surface of each gripper finger.

17. The gripping mechanism of claim 15, wherein each slot has two inner side walls that are inclined at a predetermined angle relative to an outer front wall of the back portion of the finger supporting member.

18. The gripping mechanism of claim 1, wherein a gripper pivot bracket configured for accommodating the gripper levers for facilitating opening and closing of the gripper levers has a first clevis bracket and an opposite second clevis bracket, both brackets being integrally formed with the gripper pivot bracket transverse to ears of the gripper pivot bracket for pivotally connecting the gripper levers to the gripper pivot bracket.

19. A gripper finger for use with an apparatus for removing and inserting a rail tie that needs repair or replacement from a railroad track, the gripper finger configured for removably being attached to a pair of gripper levers for grasping the rail tie, each gripper lever being actuated between a closed position and an open position, the apparatus having a finger supporting member being attached to each corresponding gripper lever and configured for accommodating a plurality of gripper fingers, the gripper finger comprising:

a plurality of teeth disposed on a front surface of the gripper finger for securely grasping the rail tie, each tooth protruding from the front surface and the plurality of teeth being vertically arranged and spaced on the front surface at a predetermined distance, the gripper finger being configured for being replaceable from the corresponding gripper lever, wherein the front surface of the gripper finger has a front vertical planar face positioned between a pair of inclined faces, each inclined face being horizontally angled from the planar face toward a corresponding side surface of the finger.

20. A gripper finger for use with an apparatus for removing and inserting a rail tie that needs repair or replacement from a railroad track, the gripper finger configured for removably being attached to a pair of gripper levers for grasping the rail tie, each gripper lever being actuated between a closed position and an open position, the apparatus having a finger supporting member being attached to each corresponding gripper lever and configured for accommodating a plurality of gripper fingers, the gripper finger comprising:

a plurality of teeth disposed on a front surface of the gripper finger for securely grasping the rail tie, each tooth protruding from the front surface and the plurality of teeth being vertically arranged and spaced on the front surface at a predetermined distance, the gripper finger being configured for being replaceable from the corresponding gripper lever;

a plurality of gripper fingers, each configured for being attachable to and removable from a corresponding one of the at least one gripper lever for grasping the rail tie; and said front surface of the gripper finger has a front vertical planar face positioned between a pair of side extending faces, each side extending face displacing the planar face from a corresponding side surface of the finger in an opposite direction from a direction of protrusion of said teeth.

* * * * *